US007918621B2

(12) United States Patent
Battisti

(10) Patent No.: US 7,918,621 B2
(45) Date of Patent: Apr. 5, 2011

(54) APPLICATOR AND TUBE DISPENSER FOR LOW AND HIGH VISCOSITY ADHESIVE COMPONENTS

(75) Inventor: Peter Battisti, Alpharetta, GA (US)

(73) Assignee: Clast Trading Ltd., Hong Kong (HK)

( * ) Notice: Subject to any disclaimer, the term of this patent is extended or adjusted under 35 U.S.C. 154(b) by 151 days.

(21) Appl. No.: 11/298,376

(22) Filed: Dec. 9, 2005

(65) Prior Publication Data

US 2007/0131356 A1 Jun. 14, 2007

(51) Int. Cl.
*B43K 5/14* (2006.01)

(52) U.S. Cl. ..... 401/134; 401/207

(58) Field of Classification Search ..... 401/132–136, 401/203, 204, 205, 207, 183–186
See application file for complete search history.

(56) References Cited

U.S. PATENT DOCUMENTS

| | | | | |
|---|---|---|---|---|
| 3,881,628 | A * | 5/1975 | Brainerd et al. | 220/23.91 |
| 3,951,157 | A | 4/1976 | Idec | |
| 4,138,040 | A | 2/1979 | Stock | |
| 4,456,150 | A | 6/1984 | Yang | |
| 4,747,719 | A | 5/1988 | Parkin | |
| 4,747,720 | A | 5/1988 | Bellehumeur et al. | |
| 4,925,327 | A * | 5/1990 | Wirt | 401/205 |
| 4,983,061 | A | 1/1991 | Demarest | |
| 5,018,894 | A | 5/1991 | Goncalves | |
| 5,427,275 | A | 6/1995 | Hansen | |
| 5,577,851 | A | 11/1996 | Koptis | |
| 5,711,453 | A | 1/1998 | Weiler | |
| 6,422,778 | B2 * | 7/2002 | Baumann et al. | 401/266 |
| 6,682,246 | B2 * | 1/2004 | Reggiani | 401/264 |

FOREIGN PATENT DOCUMENTS

| | | |
|---|---|---|
| GB | 2126999 A | 4/1984 |
| WO | 91/12197 | 8/1991 |
| WO | 9719760 A1 | 6/1997 |
| WO | 0149423 A1 | 7/2001 |

* cited by examiner

*Primary Examiner* — David J Walczak
(74) *Attorney, Agent, or Firm* — Jonathan Rigdon Smith, PC; Jonathan R. Smith

(57) ABSTRACT

A tube dispenser for adhesive compositions and adhesive components is equipped with a sponge applicator device. The tube includes an upper neck body which is cylindrical with exterior threads so that the sponge applicator device may be attached. The sponge applicator device has a rigid cap portion with interior threads, a cylindrical top end having a longitudinal channel, an absorbent, porous applicator material covering the external opening of the longitudinal channel, and a lance centered within the threaded cap and coaxial with the longitudinal channel. The porous applicator material may be affixed to the external opening of the top end with an adhesive, or held in place by a snap ring.

14 Claims, 7 Drawing Sheets

SECTION A-A

SECTION C-C

SECTION D-D

APPLICATOR AND TUBE DISPENSER FOR LOW AND HIGH VISCOSITY ADHESIVE COMPONENTS

DETAILED DESCRIPTION OF THE INVENTION

Figures 2, 3, 4:
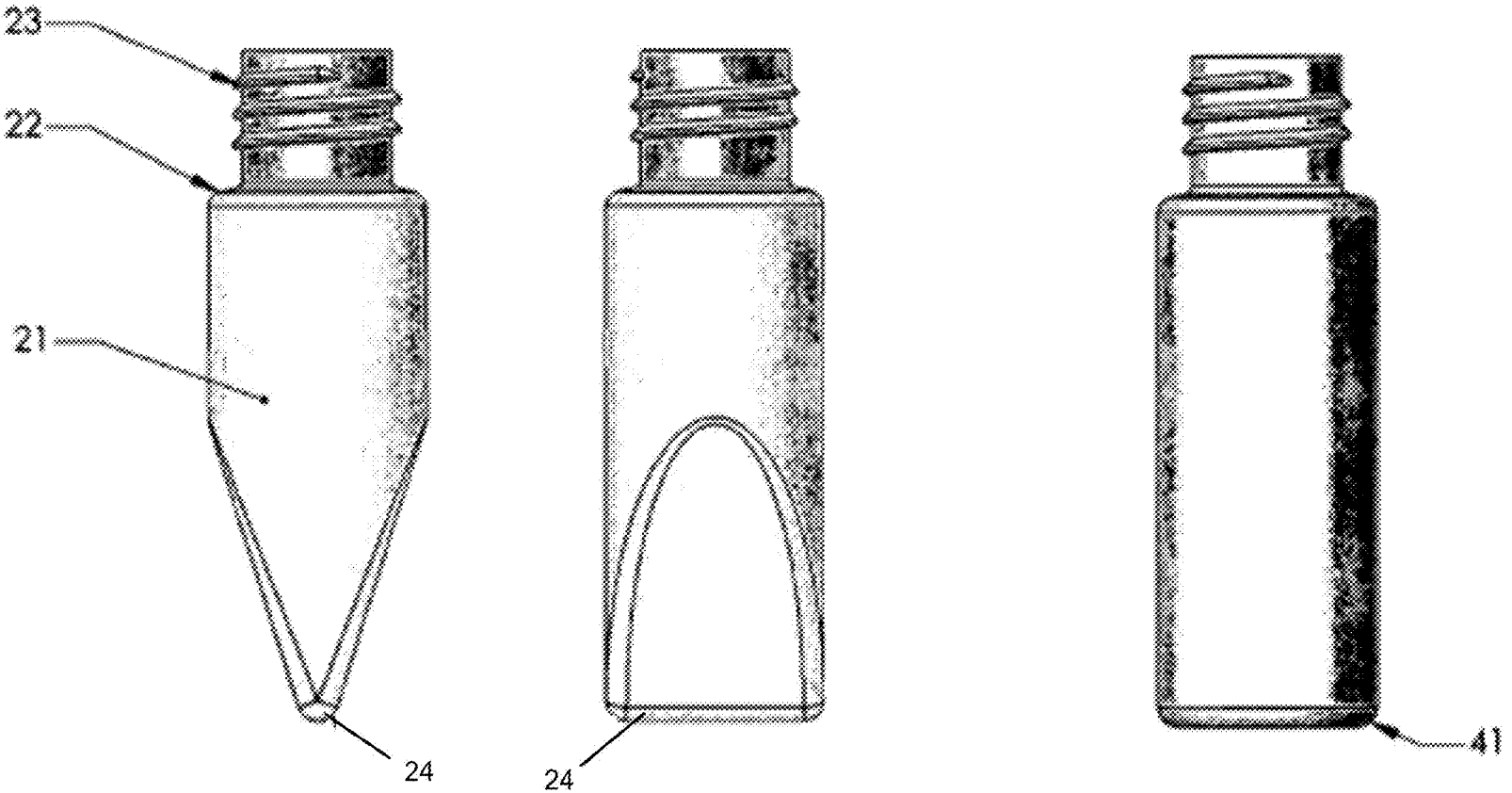
FIG. 2 is a longitudinal view of one embodiment of the tube dispenser.
FIG. 3 is another longitudinal view of one embodiment of the tube dispenser.
FIG. 4 is a longitudinal view of another embodiment of the tube dispenser.

In one embodiment of the invention, a tube dispenser for low and high viscosity adhesives or adhesive components comprises a tube dispenser as shown in FIG. 2, having a main tubular body 21, an upper neck portion extending outwardly from the upper end of the main tubular body 21, wherein the upper neck portion comprises a spiral exterior thread 23. The upper end of the neck portion is sealed to contain the low and high viscosity adhesive components, and to prevent the intrusion of moisture or other contaminants which would contaminate or initiate premature polymerization of the cyanoacrylate adhesive composition. The lower end portion of the tube dispenser can be sealed with a flat horizontal seal 24. The tube should have at least one portion which is squeezable with mild to moderate pressure, so that the contents of the tube may be easily dispensed through the applicator when the seal of the tube is opened. FIG. 3 illustrates another longitudinal view of a tube dispenser, rotated 90° from FIG. 2. In another embodiment of the invention, the lower end portion of a tube dispenser is closed with a flat bottom 41, as illustrated in FIG. 4. The tube may be made of any material commonly used to make tubes as described herein. Commonly used materials include aluminum or aluminum alloys. Other tube dispensers which contain a material to be delivered, and are sealed with a pierce able seal could be used with the sponge applicator cap.

The adhesives, or adhesive components, can be applied from the tube dispenser with a sponge applicator. In one embodiment of the invention illustrated in FIG. 1, the sponge applicator comprises a rigid cap portion, 11, having interior threads, 12, a cylindrical top end, 13, having a longitudinal channel, 14, an absorbent porous applicator material, 15, covering the external opening 17 of the longitudinal channel 14, and a lance, 16, centered within the threaded cap and coaxial with the longitudinal channel, 14. The absorbent porous applicator material may be any absorbent material that allows passage of the adhesive. Exemplary absorbent materials include without limitation, an open cell form, cloth, cotton wool, or mesh. Upon attaching the sponge applicator to the tube reservoir, as the applicator cap is screwed onto the threads of the tube, the lance is pressed against the seal, and pierces the seal to open the tube. Upon compression or squeezing of the tube, the contents flow through the longitudinal channel, 14, and into the absorbent porous applicator material, 15, from where they can be applied to a desired area through any appropriate method, including dabbing, or a swabbing motion.

Figure 7:
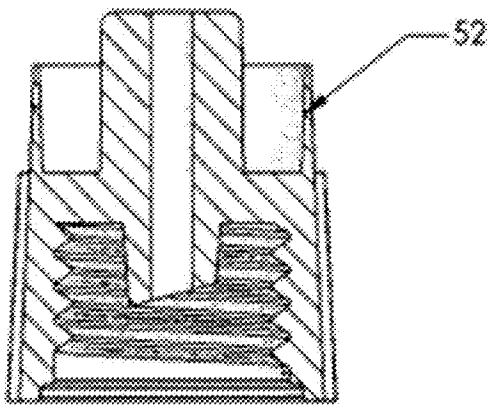
FIG. 7 is a longitudinal cross section of another embodiment of the lower portion of the applicator cap.
Figure 6:
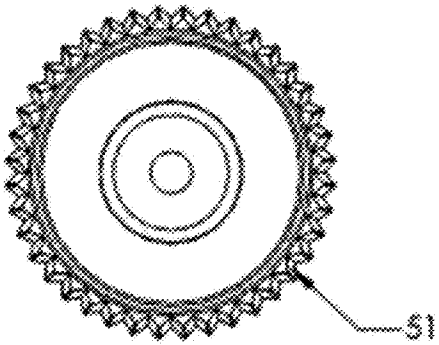
FIG. 6 is a cross sectional view of one embodiment of the lower portion of the applicator cap having longitudinal ridges.
Figure 5:
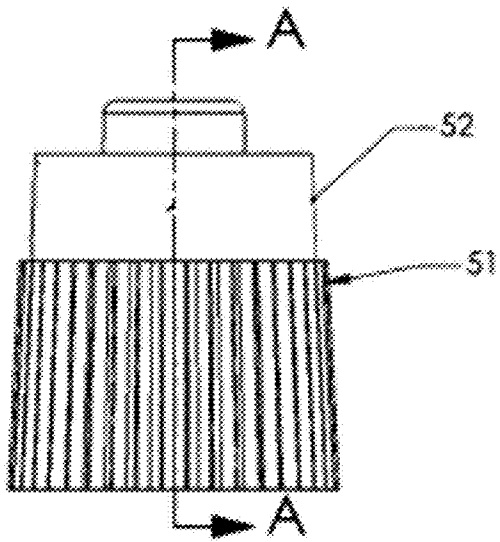
FIG. 5 is a longitudinal view of one embodiment of the lower portion of the applicator cap having longitudinal ridges.
Figure 9:
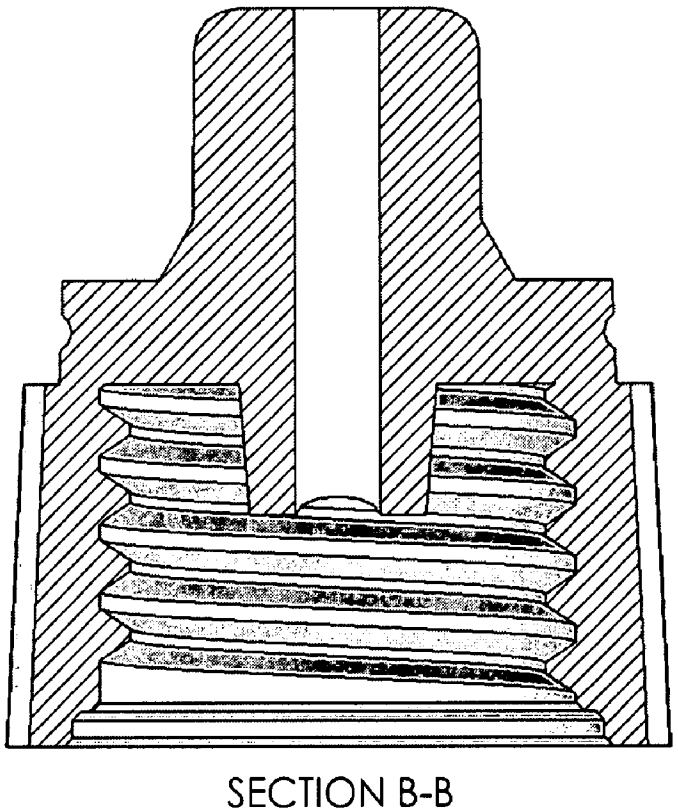
FIG. 9 is a longitudinal cross section of an embodiment without longitudinal ridges and having a circumferential groove.

In another embodiment of the invention, the rigid cap portion may further comprise longitudinal ridges 51, disposed on the exterior of the rigid cap portion as illustrated in FIGS. 5 and 6, to facilitate holding the cap portion when screwing it onto the tube dispenser in preparation to apply the adhesive or adhesive components. The rigid cap portion may also comprise a cylindrical flange 52, extending upward coaxially from the rigid cap portion as illustrated in FIGS. 5 and 7.

Figure 8:
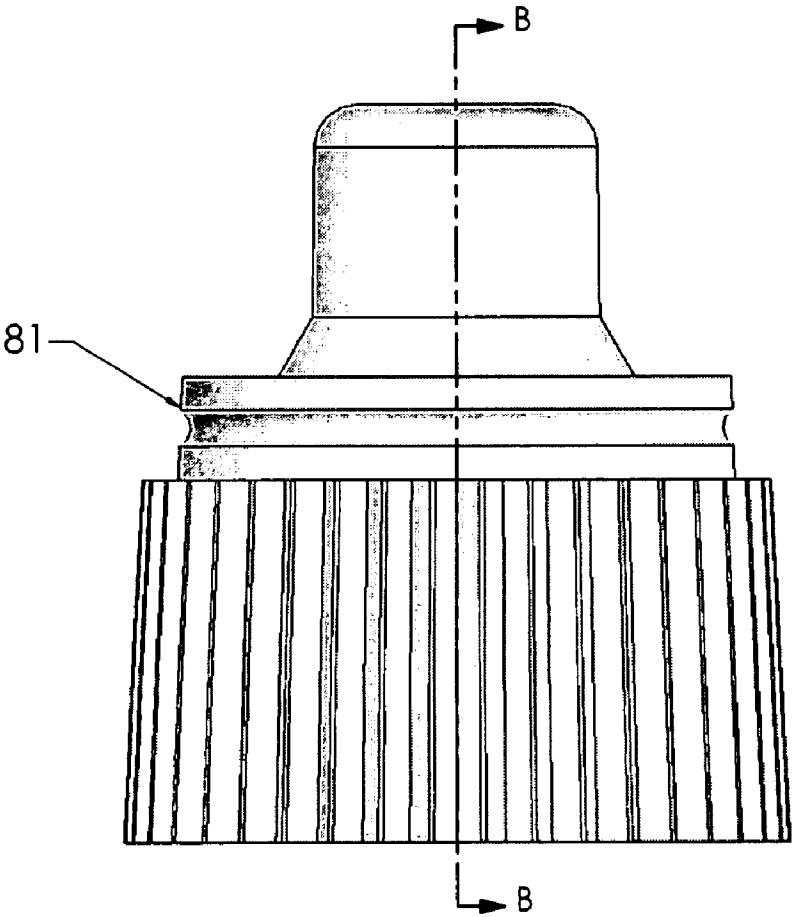
FIG. 8 is a longitudinal view of another embodiment of the lower portion of the applicator cap having ridges, and a circumferential groove.

In yet another embodiment of the invention, the rigid cap portion further comprises a circumferential groove 81, as illustrated in FIG. 8.

Figure 1:
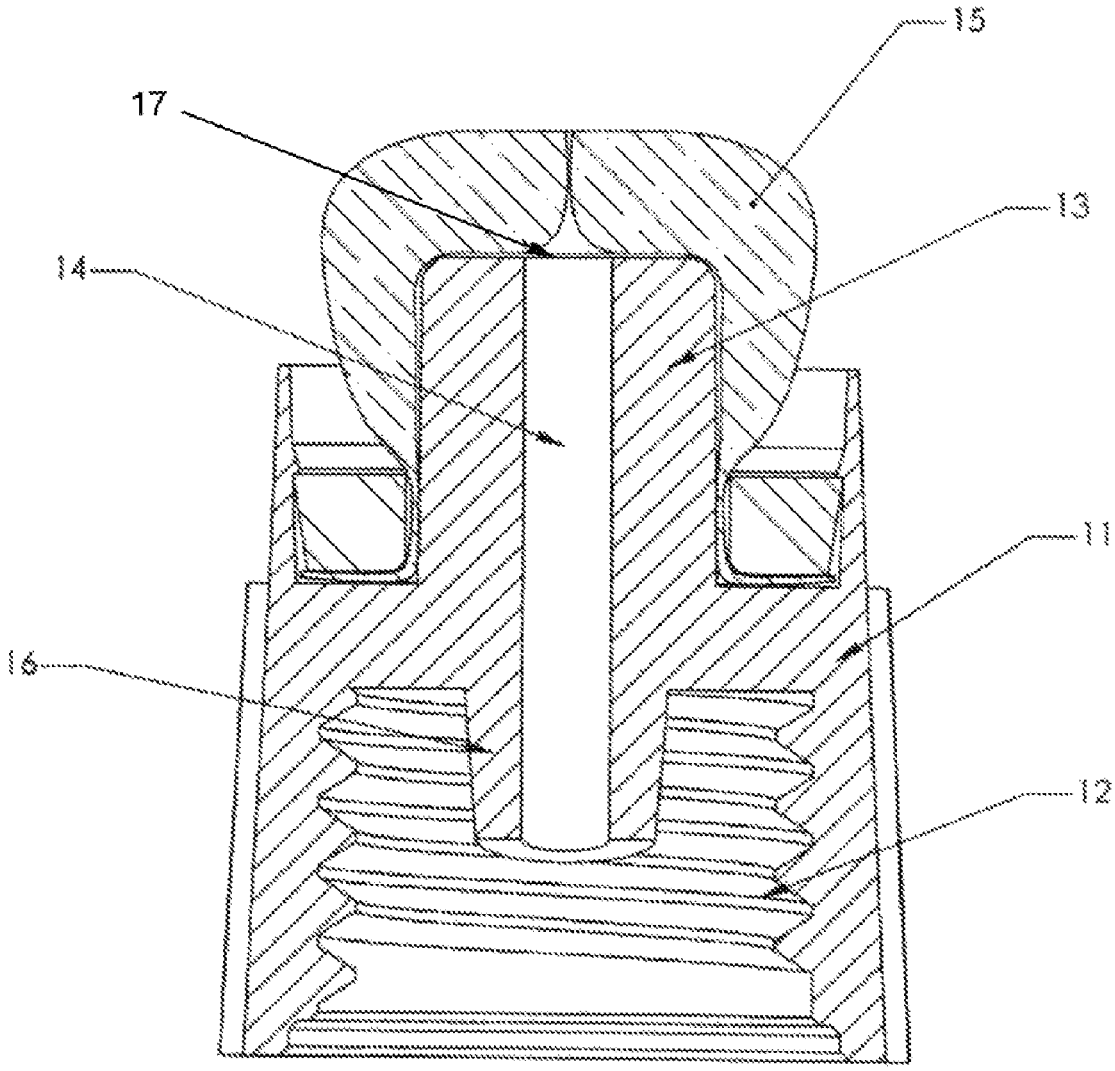
FIG. 1 is a longitudinal cross section of the sponge applicator cap.

In some embodiments of the invention, the absorbent porous applicator material, 15, of FIG. 1 is affixed to the said cylindrical top end with an adhesive. Any particular kind of adhesive which would provide adhesion of the absorbent porous applicator material to the cylindrical top would be appropriate, including hot melt adhesives, air curable adhesives, or thermosetting adhesives would suffice. In other embodiments of the invention, the absorbent applicator material is held in place enclosing the cylindrical top end of the cap by a snap ring illustrated in FIGS. 1-0, 11 and 12. In some embodiments, the snap ring further comprises a cylindrical flange, 122, extending upward coaxially as illustrated in FIG. 12.

Figure 11:
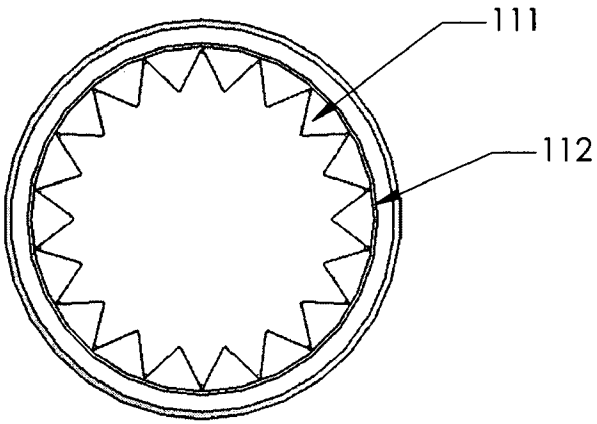
FIG. 11 is a top view of one embodiment of a snap ring illustrating teeth for securing the absorbent porous applicator material.
Figure 10:
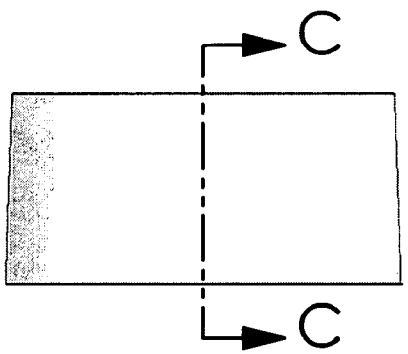
FIG. 10 is a longitudinal view of one embodiment of a snap ring.
Figure 13:
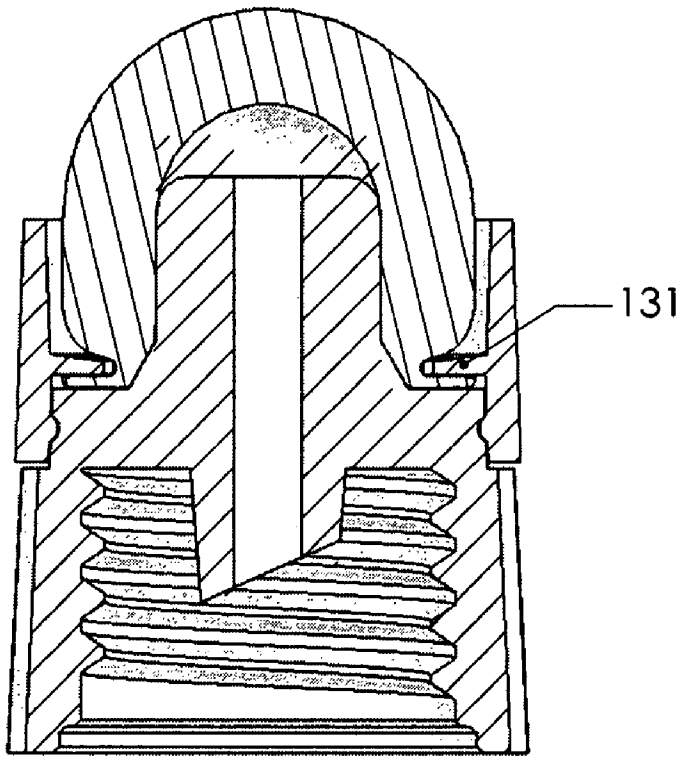
FIG. 13 is a longitudinal cross section of one embodiment of a sponge applicator assembly.
Figure 14:
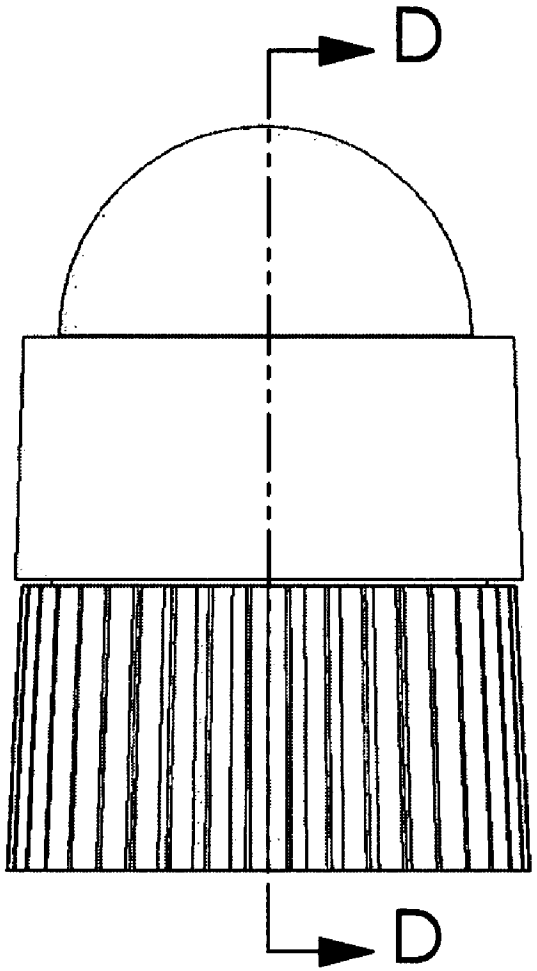
FIG. 14 is a longitudinal view of a sponge applicator assembly.

FIG. 11 illustrates one embodiment of the snap ring wherein the means for securing the absorbent porous applicator is a series of teeth 111, arrayed around the interior circumference 112, of the snap ring. In another embodiment of the snap ring, the means for securing the absorbent porous applicator is a flange 131, disposed around the interior circumference of the snap ring as illustrated in FIG. 13.

Figure 12:
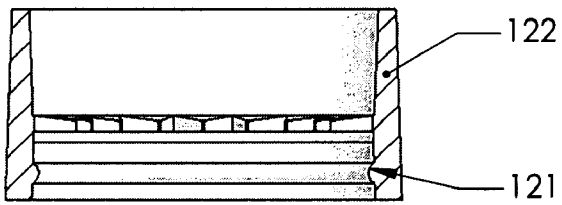
FIG. 12 is a longitudinal cross section of one embodiment of a snap ring illustrating teeth for securing the absorbent porous applicator material.

As illustrated in FIG. 12, the snap ring further comprises an inner circumferential ring 121, disposed to engage the circumferential groove 81, of the rigid cap portion of the sponge applicator.

Figure 15:
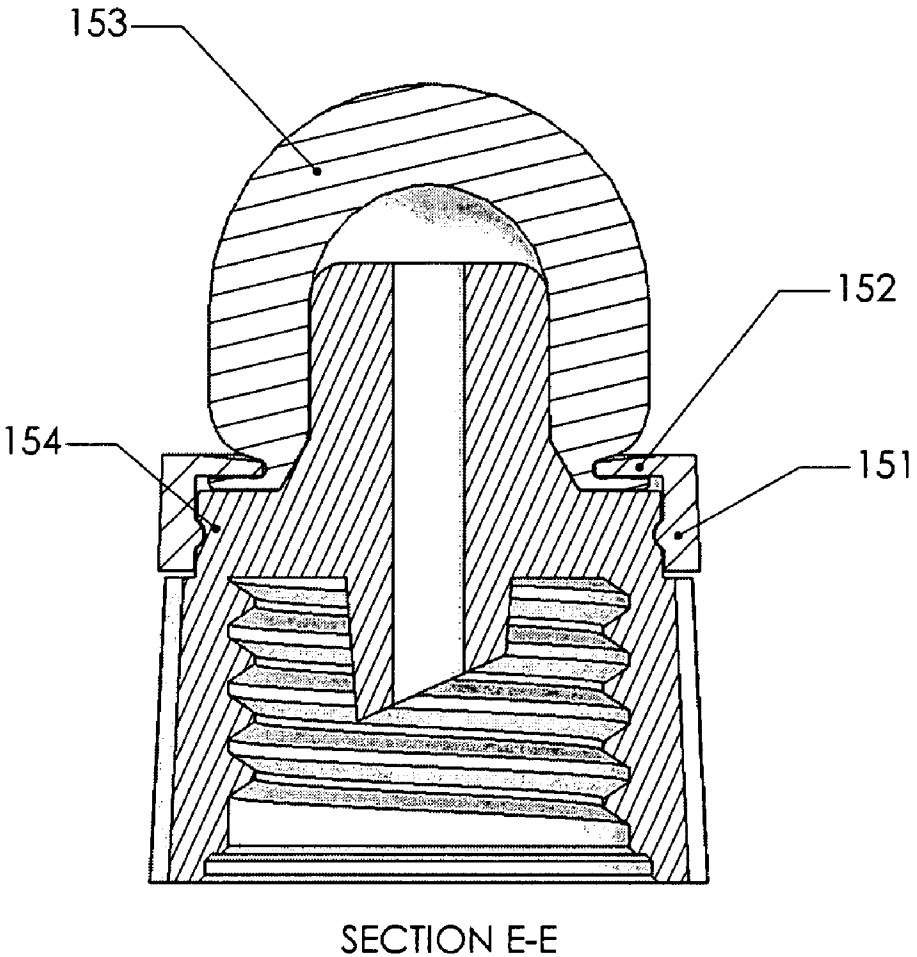
FIG. 15 is a longitudinal cross section of another embodiment of a sponge applicator assembly with a flange for securing the absorbent porous material and without an external cylindrical flange.
Figure 16:
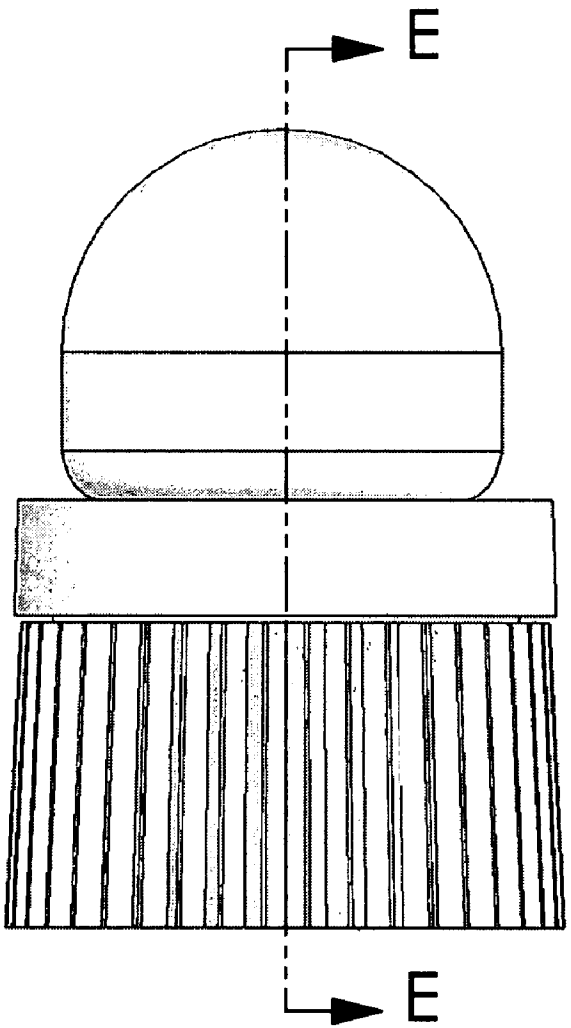
FIG. 16 is a longitudinal view of another embodiment of a sponge applicator assembly without an external cylindrical flange.

FIG. 15 illustrates an embodiment of the sponge applicator having an inner circumferential ring 151, engaging the circumferential groove 154, of the cylindrical top end, and a flange 152 for securing the absorbent porous applicator 153, wherein there is no cylindrical flange extending upward coaxially as in other embodiments.

In one embodiment of the invention, the adhesive to be dispensed and applied with the applicator is a cyanoacrylate composition comprising a cyanoacrylate monomer or monomers which can be selected from the group consisting of alkyl 2-cyanoacrylate, alkenyl 2-cyanoacrylate, alkoxyalkyl 2-cyanoacrylate, or carbalkoxyalkyl 2-cyanoacrylate. The alkyl group of the cyanoacrylate monomer or monomers preferably has 2 to 12 carbon atoms, and includes cycloalkyl functionality. Suitable cyanoacrylates include for example methyl 2-cyanoacrylate, ethyl 2-cyanoacrylate, n-propyl 2-cyanoacrylate, iso-propyl 2-cyanoacrylate, n-butyl 2-cyanoacrylate, iso-butyl 2-cyanoacrylate, hexyl 2-cyanoacrylate, n-octyl 2-cyanoacrylate, 2-octyl 2-cyanoacrylate, 2-methoxyethyl 2-cyanoacrylate, 2-ethoxyethyl 2-cyanoacrylate and 2-propoxyethyl 2-cyanoacrylate. In some embodiments of the invention, the cyanoacrylate monomers include n-butyl 2-cyanoacrylate, n-octyl 2-cyanoacrylate and mixtures thereof.

In another embodiment of the invention, the cyanoacrylate composition further comprises a thickener so as to increase the viscosity of the cyanoacrylate adhesive. Depending on the molecular weight of the thickening polymer, and the amount used, the viscosity of the adhesive composition can be anywhere from water-like, to almost paste-like. Suitable thickeners include polymers which are soluble in the cyanoacrylate monomer. Polymer compounds which may be used as a thickening agent include biologically suitable polymer compounds made from at least one cyanoacrylate monomer. As stated above, the cyanoacrylate family includes ethyl cyanoacrylate, n-propyl cyanoacrylate, isopropyl cyanoacrylate, n-butyl cyanoacrylate, isobutyl cyanoacrylate, n-amyl cyanoacrylate, isoamyl cyanoacrylate, hexylcyanoacrylate octylcyanoacrylate, decylcyanoacrylate, 3-acetoxypropyl cyanoacrylate, 2-methoxypropylcyanoacrylate, 3-chloropropyl cyanoacrylate, benzyl cyanoacrylate, phenyl cyanoacrylate, alkenyl cyanoacrylate, butyl-2-cyanoacrylate, alkoxyalkyl 2-cyanoacrylates, fluorinated 2-cyanoacrylates, and carbalkoxyalkyl cyanoacrylates, depending upon acceptable toxicity and other properties for a given application. Other members of the cyanoacrylate family may be suitable to form the cyanoacrylate polymer for use as a thickening agent. Examples of cyanoacrylate polymers having a longer chain R group are poly(octylcyanoacrylate) and poly(decylcyanoacrylate).

In another embodiment of the invention, the cyanoacrylate composition further comprises a plasticizer. Suitable plasticizers include but are not limited to, tributyl citrate, acetyl tributyl citrate, dimethyl sebacate, diethylsebacate, triethyl phosphate, tri(2-ethyl-hexyl) phosphate, tri(p-cresyl) phosphate, glyceryl triacetate, glyceryl tributyrate, dioctyl adipate, isopropyl myristate, butyl stearate, lauric acid, trioctyl trimellitate, dioctyl glutarate and mixtures thereof. In yet another embodiment of the invention, the plasticizer is tributyl citrate.

In another embodiment of the invention the cyanoacrylate compositions of the invention can be stabilized against premature polymerization with anionic and free-radical polymerization inhibitors. Anionic polymerization inhibitors known in the art include soluble acidic gases (for example sulfur dioxide), and phosphoric, carboxylic and organic sulphonic acids. Free-radical polymerization inhibitors include hydroquinone, t-butyl catechol, hydroxyanisole, butylated hydroxyanisole and butylated hydroxytoluene. Preferred polymerization inhibitors include butylated hydroxyanisole, hydroxyanisole, butylated hydroxytoluene, and mixtures thereof.

What is claimed is:

1. A sponge applicator top for a dispenser, comprising:

a rigid cap having interior threads, a cylindrical top end having a longitudinal channel with an external opening and a circumferential groove;

an absorbent, porous applicator material covering the external opening of the longitudinal channel;

the absorbent, porous applicator material being held in place by a snap ring;

the snap ring further comprising an interior circumference;

a lance centered within the rigid cap and coaxial with said longitudinal channel; and the snap ring comprising an inner circumferential ring disposed coaxially with the cylindrical top end to engage the circumferential groove, and an open-ended upward-extending cylindrical flange, the snap ring further comprising a series of teeth arrayed around said interior circumference.

2. A sponge applicator as in claim 1 wherein the rigid cap portion of the sponge applicator further comprises adjacent longitudinal ridges disposed on the exterior of the cap.

3. A tube dispenser for dispensing low and high viscosity adhesives, comprising:

a tubular body portion comprised of an impermeable material compatible with the adhesives, an upper end, and a lower end, an upper neck portion extending outwardly from the upper end of the tubular body portion, the upper neck portion comprising a spiral exterior thread, the upper neck portion being sealed, and the lower end of the tube dispenser being closed, the tubular body portion further comprising at least one portion which is squeezable; and a sponge applicator for attachment around the upper neck portion and for applying the adhesive, the sponge applicator comprising a rigid cap portion having interior threads and a circumferential groove, a cylindrical top end having a longitudinal channel with an external opening, an absorbent, porous applicator material covering the external opening of the longitudinal channel, the absorbent porous applicator material being held in place by a snap ring;

a lance centered within the threaded cap and coaxial with the longitudinal channel, the snap ring further comprising an interior circumference, an inner circumferential ring disposed to engage the circumferential groove, and an open-ended upward-extending cylindrical flange, and a series of teeth arrayed around the interior circumference.

4. A tube dispenser as in claim 3 wherein the lower end of the main tubular body of the tube dispenser is sealed with a flat horizontal seal.

5. A tube dispenser as in claim 3 wherein the rigid cap portion of the sponge applicator further comprises adjacent longitudinal ridges disposed on the exterior of the cap.

6. A tube dispenser as in claim 3 and further including the low or high viscosity adhesive or adhesive component wherein the adhesive is a cyanoacrylate adhesive composition.

7. A tube dispenser as in claim 6 wherein the cyanoacrylate adhesive comprises at least one cyanoacrylate monomer or monomers which can be selected from the group consisting of alkyl 2-cyanoacrylate, alkenyl 2-cyanoacrylate, alkoxyalkyl 2-cyanoacrylate, or carbalkoxyalkyl 2-cyanoacrylate.

8. A tube dispenser as in claim 7 wherein the alkyl group of the at least one alkyl 2-cyanoacrylate monomer is selected from the group consisting of C2 to Cl2 alkyl chains.

9. A tube dispenser as in claim 7 wherein the cyanoacrylate adhesive further comprises a thickener.

10. A tube dispenser as in claim 7 wherein the cyanoacrylate adhesive further comprises a plasticizer.

11. A tube dispenser as in claim 7 wherein the cyanoacrylate adhesive further comprises a stabilizer selected from the group consisting of free radical polymerization stabilizers and anionic polymerization stabilizers.

12. A tube dispenser as in claim 9 wherein the thickener is a polymer.

13. A sponge applicator top for a dispenser comprising:

a rigid cap having interior threads, a cylindrical top end having a longitudinal channel with an external opening and a circumferential groove;

an absorbent, porous applicator material covering the external opening of the longitudinal channel;

a lance centered within the rigid cap and coaxial with said longitudinal channel;

a snap ring comprising an inner circumferential ring disposed coaxially with the cylindrical top end to engage the circumferential groove;

an open-ended upward-extending cylindrical flange;

an interior circumference; and a series of teeth arrayed around said interior circumference;

the absorbent porous applicator material being held in place by the snap ring.

14. A tube dispenser for dispensing low and high viscosity adhesives, comprising:

a tubular body portion comprised of an impermeable material compatible with the adhesives, an upper end, and a lower end;

an upper neck portion extending outwardly from the upper end of the tubular body portion, the upper neck portion comprising a spiral exterior thread, the upper neck portion being sealed, and the lower end of the tube dispenser being closed, the tubular body portion further comprising at least one portion which is squeezable;

a sponge applicator for attachment around the upper neck portion and for applying the adhesive, the sponge applicator comprising a rigid cap portion having interior threads and a circumferential groove, a cylindrical top end comprising a longitudinal channel with an external opening, an absorbent, porous applicator material covering the external opening of the longitudinal channel, a lance centered within the threaded cap and coaxial with the longitudinal channel, a snap ring, comprising an interior circumference, a series of teeth arrayed around the interior circumference, an inner circumferential ring disposed to engage the circumferential groove, and an upward-extending cylindrical flange;

the absorbent, porous applicator material being held in place by the snap ring.

* * * * *